US006982123B2

(12) United States Patent
Budinger et al.

(10) Patent No.: US 6,982,123 B2
(45) Date of Patent: Jan. 3, 2006

(54) METHOD FOR REPAIR OF A NICKEL-BASE SUPERALLOY ARTICLE USING A THERMALLY DENSIFIED COATING

(75) Inventors: David Edwin Budinger, Loveland, OH (US); Brent Ross Tholke, Cincinnati, OH (US); Matthew Nicklus Miller, Maineville, OH (US); Warren Davis Grossklaus, Jr., West Chester, OH (US); Joshua Leigh Miller, West Chester, OH (US); Melvin Robert Jackson, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 124 days.

(21) Appl. No.: 10/703,010

(22) Filed: Nov. 6, 2003

(65) Prior Publication Data

US 2005/0100663 A1 May 12, 2005

(51) Int. Cl.
*B32B 15/01* (2006.01)
*B23K 31/00* (2006.01)

(52) U.S. Cl. ..... 428/680; 428/636; 428/544; 428/926; 29/889.1; 29/402.01; 29/402.09; 29/402.13; 29/402.16; 29/402.18; 148/527; 228/119; 228/262.3

(58) Field of Classification Search ..... 428/680, 428/636, 544, 926; 29/889.1, 402.01, 402.09, 29/402.13, 402.16, 402.18; 148/527; 228/119, 228/262.3

See application file for complete search history.

(56) References Cited

U.S. PATENT DOCUMENTS

| | | | |
|---|---|---|---|
| 4,073,639 A | 2/1978 | Duvall et al. | |
| 4,381,944 A | 5/1983 | Smith et al. | |
| 4,830,934 A | 5/1989 | Ferrigno et al. | |
| 5,240,491 A | 8/1993 | Budinger et al. | |
| 5,561,827 A | 10/1996 | Reeves et al. | |
| 5,916,518 A | 6/1999 | Chesnes | |
| 6,233,822 B1 | 5/2001 | Grossklaus, Jr. et al. | |
| 6,464,128 B1 * | 10/2002 | Messelling et al. | 228/119 |

FOREIGN PATENT DOCUMENTS

| | | |
|---|---|---|
| EP | 0 095 668 A1 | 12/1983 |
| EP | 0 293 695 A1 | 12/1988 |
| EP | 1 226 896 A2 | 7/2002 |
| EP | 1 491 283 A1 | 12/2004 |
| WO | WO 97/37800 | 10/1997 |

* cited by examiner

*Primary Examiner*—Robert R. Koehler
(74) *Attorney, Agent, or Firm*—McNees Wallace & Nurick LLC

(57) ABSTRACT

A nickel-base superalloy article, such as a gas turbine stationary flowpath shroud that has previously been in service, is repaired by applying a restoration coating to a surface of the article. The restoration coating is applied by providing a precursor mixture, wherein the precursor mixture has no more than about 15 weight percent chromium and no more than about 0.01 percent yttrium, and wherein the precursor mixture includes a higher-melting-point alloy component and a lower-melting-point alloy component. The precursor mixture is applied to the surface of the article, in a form such as a preform of the alloy components. The article with the precursor mixture applied to the surface thereof is heated to a sufficiently high temperature to melt the lower-melting-point alloy component, thereby forming the restoration coating on the surface of the article.

21 Claims, 4 Drawing Sheets

METHOD FOR REPAIR OF A NICKEL-BASE SUPERALLOY ARTICLE USING A THERMALLY DENSIFIED COATING

This invention relates to the repair of a nickel-base superalloy article and, more particularly, to a repair for restoring a dimension of the article.

BACKGROUND OF THE INVENTION

In an aircraft gas turbine (jet) engine, air is drawn into the front of the engine, compressed by a shaft-mounted compressor, and mixed with fuel. The mixture is combusted, and the resulting hot combustion gas is passed through a turbine mounted on the same shaft. The turbine includes a rotating turbine disk with turbine blades supported on its periphery, and a stationary (that is, not rotating) gas turbine flowpath shroud that confines the combustion gas to flow through the annulus between the turbine disk and the shroud, and thence against the turbine blades. The constrained flow of hot combustion gas turns the turbine by contacting an airfoil portion of the turbine blade, which turns the shaft and provides power to the compressor. The rotating turbine blades and the gas turbine stationary flowpath shroud are heated to high temperatures by the hot combustion gas. To aid them in withstanding the high external temperatures, they are typically cooled by flows of compressed cool air that are conducted through their interiors and exit at cooling holes in their surfaces. The hot exhaust gases flow from the back of the engine, driving it and the aircraft forward.

During service, the turbine disk, the turbine blades, and the gas turbine stationary flowpath shroud are all corroded, eroded, and oxidized by the hot combustion gas, and material is also lost by rubbing. Some of the metal of the turbine blades and the gas turbine stationary flowpath shroud is burned away, reducing the dimensions of the components below that which is acceptable for economic operation of the gas turbine engine. Rotor excursions, due to causes such as power bursts or hard landings, produce rubs between the turbine blades and the shroud that dig into the shroud. Consequently, with increasing periods of service, the clearance gap between the turbine blades and the gas turbine stationary flowpath shroud is increased. Eventually, the efficiency of the gas turbine suffers because hot combustion gas leaks through the clearance gap between the tips of the turbine blades and the gas turbine stationary flowpath shroud and does not perform work to turn the turbine blades.

When the gas turbine engine is overhauled, it is conventional practice to restore the dimensions of the components to within their original manufactured tolerances, thereby regaining the efficiency of the gas turbine. In the case of the gas turbine stationary flowpath shroud, techniques are known to conduct this repair with thermally densified coatings, see for example U.S. Pat. No. 5,561,827, whose disclosure is incorporated by reference. In this approach, a preform is prepared and bonded to the flowpath surface of the gas turbine stationary flowpath shroud, and the cooling holes are redrilled. This approach has been successful for restoring the dimensions of the gas turbine stationary flowpath shroud, and, in conjunction with techniques for restoring the turbine blades, for returning the gas turbine to its specification dimensions and thence to its original efficiencies.

However, in some instances there has been observed a preferential oxidation at the openings of the cooling holes of the gas turbine flowpath shroud, after it is returned to service. This preferential oxidation may cause the bore of the cooling holes to be significantly reduced, so that the flow of cooling air is reduced. The damage to the repaired gas turbine stationary flowpath shroud caused by the hot combustion gas during the subsequent service is consequently accelerated. Various alternative repair techniques for the gas turbine stationary flowpath shroud have been tried, but these alternatives either result in the same preferential oxidation at the cooling holes or in premature crack initiation in the restoration that is propagated into the substrate.

There is a need for a repair procedure for the gas turbine stationary flowpath shrouds that is satisfactory in restoring its dimensions, but at the same time does result in the preferential oxidation around the cooling holes and premature cracking of the restoration and substrate during service. The present invention fulfills this need, and further provides related advantages.

SUMMARY OF THE INVENTION

The present invention provides a method for repairing a nickel-base superalloy article that has previously been in service and has its dimensions reduced. The present approach is used to restore the dimensions of the article, specifically the thickness dimension in the case of the gas turbine stationary flowpath shroud, to within acceptable tolerances. The present approach is effective to build up the dimensions, but does not result in a restoration, which preferentially oxidizes at the cooling holes. The restoration is also resistant to premature cracking in service. The method uses an application technique that is well established for other applications. The present approach is particularly useful where the repaired article is heated in service to quite high temperatures by the hot combustion gas, such as temperatures of not less than about 1800° F., and preferably not less than about 1900° F.

A method for repairing a nickel-base superalloy article comprises the steps of providing the nickel-base superalloy article that has previously been in service, and applying a restoration coating to a surface of the article. The restoration coating is applied by providing a precursor mixture having no more than about 15 weight percent chromium, preferably no more than about 12 weight percent chromium, and most preferably about 10 weight percent chromium. The restoration coating has no more than about 0.01 percent yttrium, and preferably substantially no yttrium (i.e., no more than about 0.001 percent). The precursor mixture comprises a higher-melting-point alloy component, and a lower-melting-point alloy component. Optionally but preferably, after the step of providing and before the step of applying, a preform of the higher-melting-point alloy component and the lower-melting-point alloy component is formed. The precursor mixture is applied to the surface of the article. Thereafter, the article with the precursor mixture applied to the surface thereof is heated to a sufficiently high temperature to melt the lower-melting-point alloy component, thereby forming the restoration coating on the surface of the article. Preferably after the step of applying is fully completed, the article is returned to service.

The nickel-base superalloy article is preferably a gas turbine stationary flowpath shroud as the article. Typically, the gas turbine stationary flowpath shroud has flowpath cooling holes therein as the article. In that case, the cooling holes are redrilled after the step of heating.

In a preferred embodiment, the nickel-base restoration alloy of the restoration coating has a net nominal composition in weight percent of about 7.5 percent cobalt, about 7.0 percent chromium, about 1.5 percent molybdenum, about 5 percent tungsten, about 3 percent rhenium, about 6.5 percent tantalum, about 6.2 percent aluminum, about 0.15 percent hafnium, about 0.05 percent carbon, about 0.004 percent boron, about 0.01 percent yttrium, balance nickel and impurities, and in this case is a nickel-base superalloy. The higher-melting-point alloy component has a nominal composition in weight percent of about 3.1 percent cobalt, about 7.6 percent chromium, about 0.1 percent maximum molybdenum, about 3.85 percent tungsten, about 0.02 percent maximum titanium, about 1.65 percent rhenium, about 0.55 percent silicon, about 5.45 percent tantalum, about 7.8 percent aluminum, about 0.15 percent hafnium, about 0.02 percent carbon, balance nickel and impurities. In another formulation, the higher-melting-point alloy component has a nominal composition in weight percent of 0.01–0.03 percent carbon, 0.1 percent maximum manganese, 0.5–0.6 percent silicon, 0.01 percent maximum phosphorus, 0.004 percent maximum sulfur, 7.4–7.8 percent chromium, 2.9–3.3 percent cobalt, 0.01 percent maximum molybdenum, 3.7–4.0 percent tungsten, 5.3–5.6 percent tantalum, 0.02 percent maximum titanium, 7.6–8.0 percent aluminum, 1.5–1.8 percent rhenium, 0.005 percent maximum selenium, 0.3 percent maximum platinum, 0.01–0.02 percent boron, 0.03 percent maximum zirconium, 0.12–0.18 percent hafnium, 0.1 percent maximum niobium, 0.1 percent maximum vanadium, 0.1 percent maximum copper, 0.2 percent maximum iron, 0.0035 percent maximum magnesium, 0.01 percent maximum oxygen, 0.01 percent maximum nitrogen, balance nickel with other elements 0.5 percent maximum. The lower-melting-point alloy component has a nominal composition in weight percent of 14.0–16.0 percent cobalt, 19.0–21.0 percent chromium, 4.5–5.5 percent aluminum, 0.05 maximum carbon, 7.7–8.1 percent silicon, 0.5 maximum percent iron, 0.1 maximum percent magnesium, balance nickel and impurities. The alloy components are preferably provided in a ratio of about 79 percent by weight of the higher-melting-point alloy component to about 21 percent by weight of the lower-melting-point alloy component.

The restoration alloy that forms the restoration coating may be a nickel-base superalloy composition different from that of the nickel-base superalloy article. However, the restoration alloy is not necessarily a nickel-base superalloy and, if it is, the restoration alloy need not be heat treated to produce gamma prime precipitates. The purpose of the restoration coating is to restore dimensions, not primarily to provide strength although it may do so.

The restoration coating is typically, but not necessarily, applied to a thickness of from about 0.100 to about 0.160 inch, although it may be applied in larger or smaller thicknesses.

The step of heating preferably is performed at a temperature of from about 2250° F. to about 2350° F., and for a time of at least about 20 minutes, most preferably to about 2295° F. to about 2325° F. for about 2 hours.

The restoration coating is resistant to oxidation, and in particular is resistant to preferential oxidation around the cooling holes. The low chromium and yttrium levels aid in reducing such oxidation, yet do not reduce the oxidation and corrosion performance of the restoration coating.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
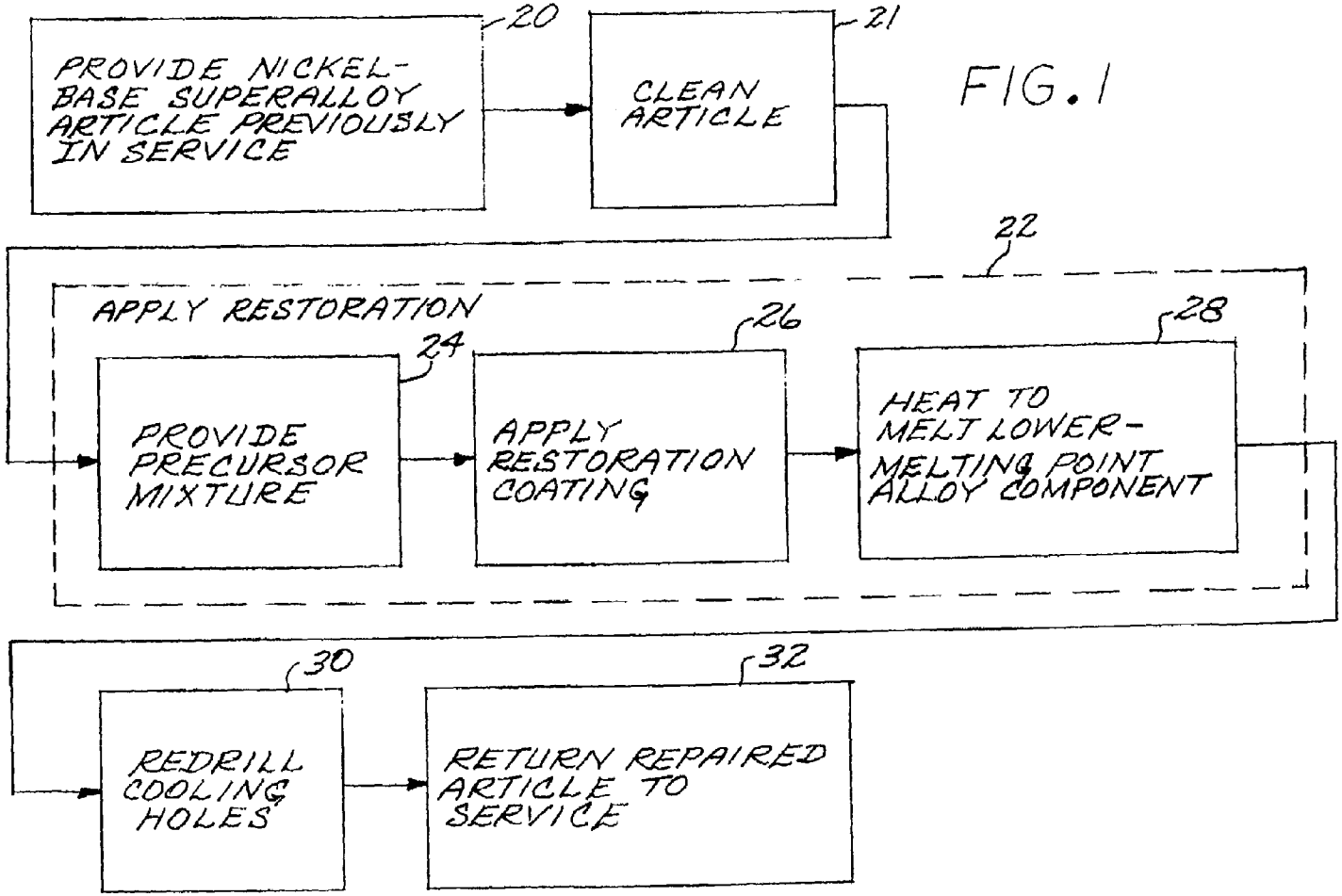
FIG. 1 is a block flow diagram of a preferred approach for practicing an embodiment of the method of the invention.

FIG. 1 depicts in block diagram form a preferred embodiment of a method for repairing a nickel-base superalloy article. In practicing the method, the nickel-base superalloy article that has previously been in service is provided, step 20. The present approach is applicable to any operable article. FIGS. 2–7 depict the use of the method in relation to a presently preferred article, a gas turbine stationary flowpath shroud.

Figure 2:
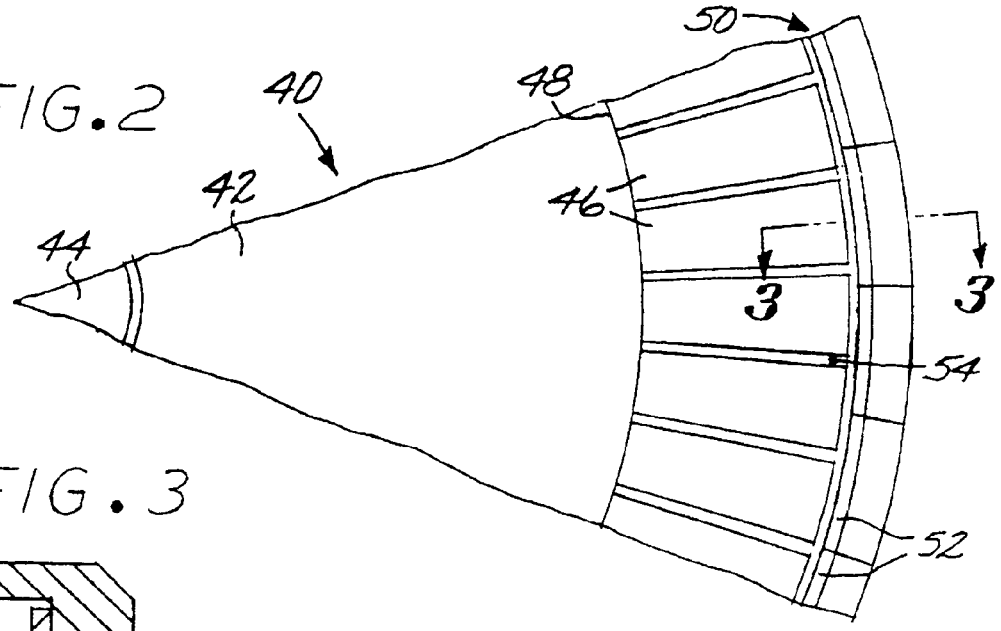
FIG. 2 is a fragmentary schematic front elevational view of a portion of a gas turbine.

FIG. 2 presents a simplified depiction of the relevant portions of a gas turbine 40, illustrating only the components of interest. The gas turbine 40 includes a turbine disk 42 that is fixed to and rotates with a center shaft 44. A plurality of turbine blades 46 extend radially outwardly from a periphery 48 of the turbine disk 42. A gas turbine stationary flowpath shroud 50 forms a tunnel-like structure in which the turbine disk 42, the shaft 44, and the turbine blades 46 rotate. The gas turbine stationary flowpath shroud 50 is termed "stationary" and does not rotate as the turbine disk 42, the shaft 44, and the turbine blades 46 rotate. The stationary gas turbine stationary flowpath shroud 50 is to be distinguished from the rotating shrouds that are found near the tips of some types of gas turbine blades. The gas turbine stationary flowpath shroud 50 is formed by a series of curved stationary shroud segments 52 that together define the cylindrical gas turbine stationary flowpath shroud 50. A combustion gas flow 54 flowing from the combustors (not shown) of the gas turbine engine is perpendicular to the plane of the drawing of FIG. 2.

Figure 3:
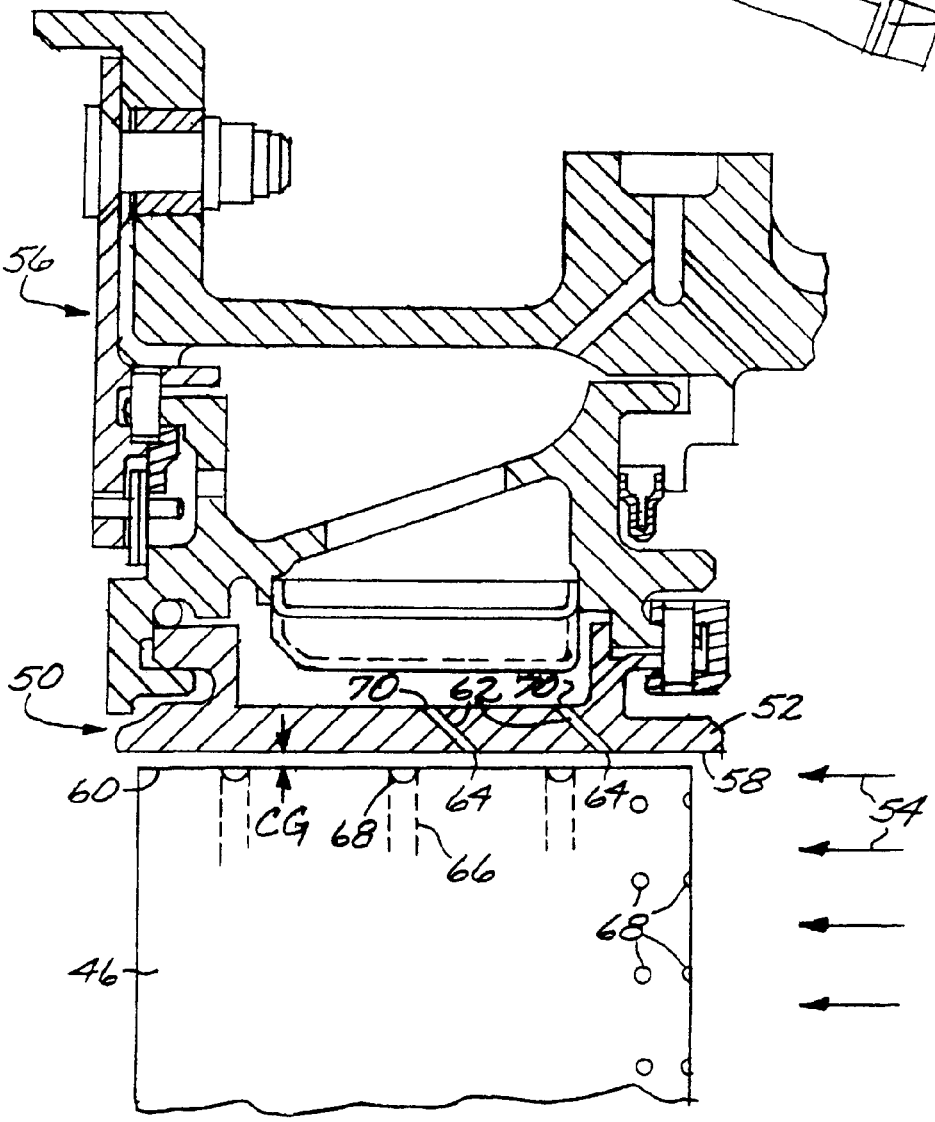
FIG. 3 is a cross-sectional view along line 3—3 of FIG. 2 of a gas turbine stationary flowpath shroud assembly and its relation to a turbine blade.

FIG. 3 illustrates the gas turbine stationary flowpath shroud 50 and one of the stationary shroud segments 52 in greater detail. Each stationary shroud segment 52 is supported on a shroud hanger structure 56. The gas turbine stationary flowpath shroud 50 and the stationary shroud segment 52 have a flowpath surface 58 that faces but is spaced apart from a tip 60 of the turbine blade 46. In the operation of the gas turbine 40, it is important that the separation of the flowpath surface 58 and the tip 60, termed the clearance gap CG, be within specified tolerance limits. During service, both the flowpath surface 58 and the tip 60 are eroded, corroded, and oxidized by the hot combustion gas 54, and occasionally rubbed together with a consequent loss of material. The value of CG therefore increases over time, until it becomes so large that an unacceptable amount of the combustion gas flow 54 leaks between the flowpath surface 58 of the stationary flowpath shroud 50 and the tip 60, so that the combustion gas does not contact the turbine blade 46 and impart energy to it. The result is the loss of efficiency of the gas turbine 40.

Figure 4:
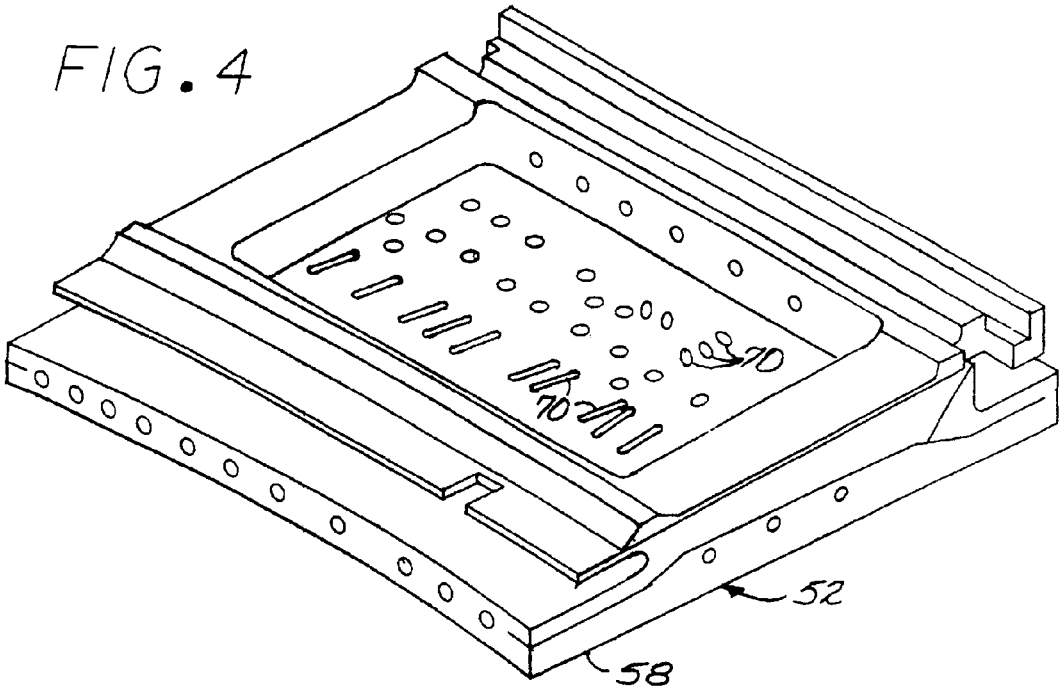
FIG. 4 is a perspective view of a segment of the gas turbine stationary flowpath shroud.
Figure 5:
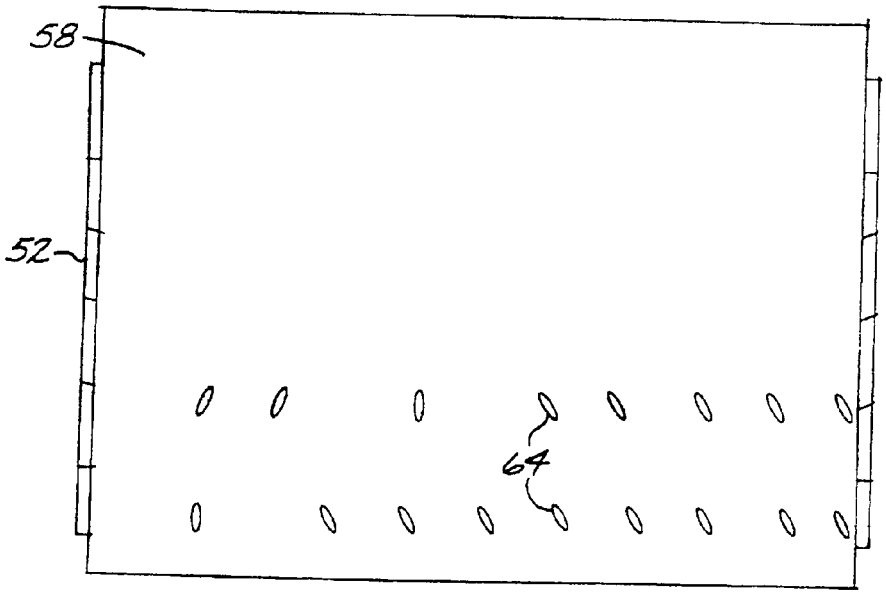
FIG. 5 is a bottom view of the gas turbine stationary flowpath shroud.
Figure 6:
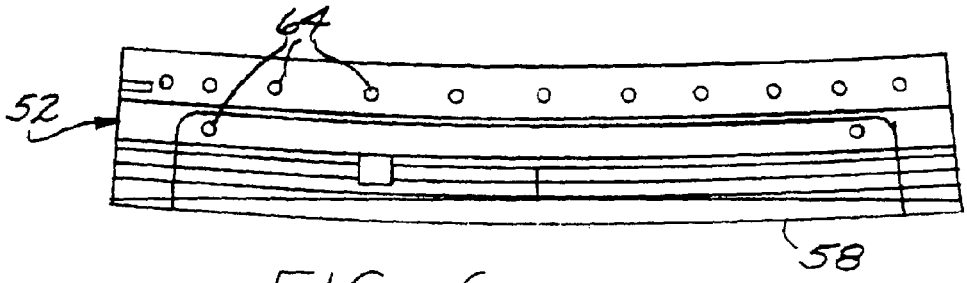
FIG. 6 is a front view of the gas turbine stationary flowpath shroud.

One technique for increasing the temperature at which the turbine blade 46 and the gas turbine stationary flowpath shroud 50 may operate is to pass a flow of a cooling gas, typically air, through their interiors. The stationary shroud segment 52 therefore has interior cooling channels 62 through which the cooling gas passes to emerge at cooling holes 64 in the flowpath surface 58. The number and pattern of the cooling holes 64 in the stationary shroud segment 52 is selected to provide the desired cooling. FIGS. 4–6 illustrate one approach to the positioning of the cooling holes 64. FIG. 4 depicts from the side opposite the flowpath surface 58 the entrance end 70 of the cooling channels 62, while FIGS. 5–6 illustrate a pattern of the cooling holes 64 from bottom (FIG. 5) and front elevational (FIG. 6) views. (The turbine blade 46 also has internal cooling channels 66 with cooling holes 68, but the present embodiment is concerned only with the stationary shroud segment 52 and not the turbine blades 42.)

The article such as the gas turbine stationary flowpath shroud 50 is most preferably made of a nickel-base superalloy. As used herein, "nickel-base" means that the composition has more nickel present than any other element. The nickel-base superalloys are of a composition that is strengthened by the precipitation of gamma-prime phase or a related phase. In a preferred case, the article is Rene® N5 alloy, which is a registered trademark of Teledyne Industries of Los Angeles, Calif., having a nominal composition in weight percent of about 7.5 percent cobalt, about 7.0 percent chromium, about 1.5 percent molybdenum, about 5 percent tungsten, about 3 percent rhenium, about 6.5 percent tantalum, about 6.2 percent aluminum, about 0.15 percent hafnium, about 0.05 percent carbon, about 0.004 percent boron, about 0.01 percent yttrium, balance nickel and impurities.

The article that has previously been in service is cleaned to remove dirt, oxidation and corrosion products, and other foreign matter resulting from the prior service, step 21. The cleaning is preferably accomplished by fluoride ion cleaning.

A restoration coating is applied to a surface, here the flowpath surface 58, of the article, here the stationary shroud segment 52, step 22. The application step 22 first includes providing a precursor mixture, step 24. The restoration coating has no more than about 15 weight percent chromium, preferably no more than about 12 weight percent chromium, and most preferably about 10 weight percent chromium. The restoration coating has no more than about 0.01 percent yttrium, and preferably substantially no yttrium (i.e., no more than about 0.001 percent). If larger amounts of chromium and yttrium are present in the restoration coating, such as 20 percent chromium and 0.07 percent yttrium, the restoration coating is operable, but there is a tendency for oxidation within the shroud cooling holes 64 that gradually plugs the cooling holes 64 and reduces the cooling air flow through them.

Thus, an article comprises a nickel-base superalloy article that has previously been in service, and a restoration coating precursor mixture applied to a surface of the article. The precursor mixture has no more than about 15 weight percent chromium and no more than about 0.01 percent yttrium. The precursor mixture comprises a higher-melting-point alloy component, and a lower-melting-point alloy component.

In a preferred embodiment, the restoration coating is made of a restoration alloy having a nominal composition in weight percent of about 10.2 percent chromium, about 5.6 percent cobalt, about 7.2 percent aluminum, about 4.3 percent tantalum, about 1.3 percent rhenium, about 3.1 percent tungsten, about 0.1 percent hafnium, about 2.1 percent silicon, substantially no yttrium, balance nickel and impurities.

The precursor mixture for this preferred embodiment is a mix of a higher-melting-point alloy component, and a lower-melting-point alloy component. These two alloy components are prepared separately, and then mixed together to make the precursor mixture. The preferred higher-melting-point alloy component has a nominal composition in weight percent of about 3.1 percent cobalt, about 7.6 percent chromium, about 0.1 percent maximum molybdenum, about 3.85 percent tungsten, about 0.02 percent maximum titanium, about 1.65 percent rhenium, about 0.55 percent silicon, about 5.45 percent tantalum, about 7.8 percent aluminum, about 0.15 percent hafnium, about 0.02 percent carbon, balance nickel and impurities. In another embodiment, the preferred higher-melting-point alloy component has a nominal composition in weight percent of 0.01–0.03 percent carbon, 0.1 percent maximum manganese, 0.5–0.6 percent silicon, 0.01 percent maximum phosphorus, 0.004 percent maximum sulfur, 7.4–7.8 percent chromium, 2.9–3.3 percent cobalt, 0.01 percent maximum molybdenum, 3.7–4.0 percent tungsten, 5.3–5.6 percent tantalum, 0.02 percent maximum titanium, 7.6–8.0 percent aluminum, 1.5–1.8 percent rhenium, 0.005 percent maximum selenium, 0.3 percent maximum platinum, 0.01–0.02 percent boron, 0.03 percent maximum zirconium, 0.12–0.18 percent hafnium, 0.1 percent maximum niobium, 0.1 percent maximum vanadium, 0.1 percent maximum copper, 0.2 percent maximum iron, 0.0035 percent maximum magnesium, 0.01 percent maximum oxygen, 0.01 percent maximum nitrogen, balance nickel with other elements 0.5 percent maximum. The lower-melting-point alloy component has a nominal composition in weight percent of 14.0–16.0 percent cobalt, 19.0–21.0 percent chromium, 4.5–5.5 percent aluminum, 0.05 maximum carbon, 7.7–8.1 percent silicon, 0.5 maximum percent iron, 0.1 maximum percent magnesium, balance nickel and impurities.

The two alloy components are mixed together in an appropriate proportion to form the precursor mixture. In a preferred embodiment, the precursor mixture has a ratio of about 79 percent by weight of the higher-melting-point alloy component to about 21 percent by weight of the lower-melting-point alloy component, producing the preferred composition of the restoration coating.

Figure 7:
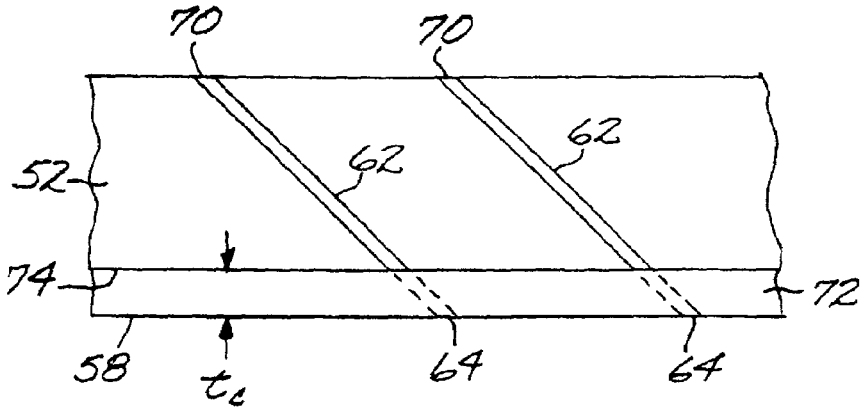
FIG. 7 is an enlarged schematic side elevational view of the gas turbine stationary flowpath shroud during the restoration process.

As shown in FIG. 7, a restoration coating 72 of the restoration nickel-base alloy is thereafter applied, step 26, to a pre-repair flowpath surface 74 by a thermally densified coating (TDC) coating process. The TDC process is a known technique for applying metallic deposits in other contexts, see for example U.S. Pat. No. 5,561,827, whose disclosure is incorporated by reference. To perform the TDC process, the higher-melting-point alloy component and the lower-melting-point alloy component are preferably mixed together and pressed to form a preform. Alternatively, the higher-melting-point alloy component and the lower-melting-point alloy component may be separately applied to the surface 74, as in a succession of two or more layers, in the appropriate weight proportions. The restoration coating may be applied in any operable thickness $t_C$ that returns the dimensions of the article to the desired values, but it is preferably applied in a thickness of from about 0.100 to about 0.160 inches.

The stationary shroud segment 52 with the coating 72 applied to the pre-repair flowpath surface 74 is thereafter heated to a sufficiently high temperature to melt the lower-melting-point alloy component, step 28. Preferably, the stationary shroud segment and the applied coating 72 are heated to a temperature of from about 2250° F. to about 2350° F. for at least about 20 minutes, most preferably to about 2295° F. to about 2325° F. for about 2 hours. The exposed surface of the coating 72 is the new, repaired flowpath surface 58.

The application process 22 typically overcoats the visible cooling holes with the coating 72. It is therefore necessary to redrill the cooling holes, step 30. The redrilling step 30, like the originally drilling of the cooling channels 62, is preferably performed by laser drilling.

Optionally, an environmental coating may be applied to protect portions of the article. The environmental coating is typically a diffusion aluminide applied by vapor phase aluminiding (VPA), a process known in the art. Any portion of the environmental coating that deposits on the flowpath surface 58 is machined away prior to the initial operation of the engine.

After the application step 22 and redrilling step 30 are complete, the repaired article with restored dimensions is returned to service, step 32.

The present approach has been reduced to practice using the preferred approach discussed above. High-pressure-turbine stationary shroud segments of the preferred substrate material were coated with the preferred restoration coating material. The coating 72 adheres well to the substrate material after the heating step 28. The coating 72 machines well in the redrilling of the cooling holes, step 30.

The coating material must be resistant to oxidation and corrosion damage, and these two properties were evaluated using uncoated and coated Rene® N5 specimens prepared by the preferred approach discussed above. For the oxidation-resistance determination, individual pin samples of the preferred substrate material were (1) coated with a prior TDC restoration coating material having a nominal composition in weight percent of about 20.0 percent chromium, about 15.0 percent cobalt, about 7.8 percent aluminum, about 2.5 percent silicon, about 0.07 percent yttrium, balance nickel and impurities, and (2) coated with the TDC preferred coating discussed above. The samples were subjected to cyclic oxidation at 2075° F. maximum temperature with Mach 0.5 combustion gas velocity, and a heating cycle of a rapid heat, 5 minutes at temperature, and a rapid cool for 2000 cycles. The samples had substantially the same oxidation performance in terms of pin diameter reduction.

In the accelerated corrosion testing, individual samples of the same types as used in the oxidation testing were prepared, and uncoated pin samples were also prepared as a baseline. The pin samples were exposed at 1700° F. for 10 minutes to Mach 0.5 flowing combustion gas, then exposed to 5.4 cubic centimeters per minute of salt solution added to the Mach 0.5 flowing combustion gas, then heated to 2075° F. for 5 minutes, and then rapidly cooled. Each sample was given 200 cycles of this type. The pins were sectioned and inspected metallographically. The effective diameter loss in inches was 0.0151 inches for the specimens prepared by the present approach, 0.0269 inches for the specimens coated with the prior TDC coating, and 0.0428 inches for the uncoated specimens. The present approach yielded significantly improved hot-salt corrosion performance.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for repairing a nickel-base superalloy article comprising the steps of:

providing the nickel-base superalloy article that has previously been in service; and applying a restoration coating to a surface of the article by the steps of providing a precursor mixture, wherein the precursor mixture has no more than about 12 weight percent chromium and no more than about 0.01 percent yttrium, and wherein the precursor mixture comprises a higher-melting-point alloy component, and a lower-melting-point alloy component; thereafter applying the precursor mixture to the surface of the article, and thereafter heating the article with the precursor mixture applied to the surface thereof to a sufficiently high temperature to melt the lower-melting-point alloy component, thereby forming the restoration coating on the surface of the article.

2. The method of claim 1, including an additional step, after the step of providing and before the step of applying, of forming a preform of the higher-melting-point alloy component and the lower-melting-point alloy component.

3. The method of claim 1, including an additional step, after the step of applying is fully completed, of returning the article to service.

4. The method of claim 1, wherein the step of providing the nickel-base superalloy article includes the step of providing a gas turbine stationary flowpath shroud as the article.

5. The method of claim 1, wherein the step of providing the nickel-base superalloy article includes the step of providing a gas turbine stationary flowpath shroud having flowpath cooling holes therein as the article.

6. The method of claim 1, wherein the step of providing the nickel-base superalloy article includes the step of providing a gas turbine stationary flowpath shroud having flowpath cooling holes therein as the article, and wherein the method includes an additional step, after the step of heating, of redrilling the cooling holes.

7. The method of claim 1, wherein the step of providing the nickel-base superalloy article includes the step of providing the article having a nominal composition in weight percent of about 7.5 percent cobalt, about 7.0 percent chromium, about 1.5 percent molybdenum, about 5 percent tungsten, about 3 percent rhenium, about 6.5 percent tantalum, about 6.2 percent aluminum, about 0.15 percent hafnium, about 0.05 percent carbon, about 0.004 percent boron, about 0.01 percent yttrium, balance nickel and impurities.

8. The method of claim 1, wherein the step of providing the precursor mixture includes the step of providing the precursor mixture having no more than about about 0.001 percent yttrium.

9. The method of claim 1, wherein the step of applying a restoration coating includes the step of applying the restoration coating having a nominal composition in weight percent of about 10.2 percent chromium, about 5.6 percent cobalt, about 7.2 percent aluminum, about 4.3 percent tantalum, about 1.3 percent rhenium, about 3.1 percent tungsten, about 0.1 percent hafnium, about 2.1 percent silicon, substantially no yttrium, balance nickel and impurities.

10. The method of claim 1, wherein the step of providing the precursor mixture includes the step of providing the higher-melting-point alloy component having a nominal composition in weight percent of about 3.1 percent cobalt, about 7.6 percent chromium, about 0.1 percent maximum molybdenum, about 3.85 percent tungsten, about 0.02 percent maximum titanium, about 1.65 percent rhenium, about 0.55 percent silicon, about 5.45 percent tantalum, about 7.8 percent aluminum, about 0.15 percent hafnium, about 0.02 percent carbon, balance nickel and impurities.

11. The method of claim 1, wherein the step of providing the precursor mixture includes the step of providing the higher-melting-point alloy component having a nominal composition in weight percent of 0.01–0.03 percent carbon, 0.1 percent maximum manganese, 0.5–0.6 percent silicon, 0.01 percent maximum phosphorus, 0.004 percent maximum sulfur, 7.4–7.8 percent chromium, 2.9–3.3 percent cobalt, 0.01 percent maximum molybdenum, 3.7–4.0 percent tungsten, 5.3–5.6 percent tantalum, 0.02 percent maximum titanium, 7.6–8.0 percent aluminum, 1.5–1.8 percent rhenium, 0.005 percent maximum selenium, 0.3 percent maximum platinum, 0.01–0.02 percent boron, 0.03 percent maximum zirconium, 0.12–0.18 percent hafnium, 0.1 percent maximum niobium, 0.1 percent maximum vanadium, 0.1 percent maximum copper, 0.2 percent maximum iron, 0.0035 percent maximum magnesium, 0.01 percent maximum oxygen, 0.01 percent maximum nitrogen, balance nickel with other elements 0.5 percent maximum.

12. The method of claim 1, wherein the step of providing the precursor mixture includes the step of providing the lower-melting-point alloy component having a nominal composition in weight percent of 14.0–16.0 percent cobalt, 19.0–21.0 percent chromium, 4.5–5.5 percent aluminum, 0.05 maximum carbon, 7.7–8.1 percent silicon, 0.5 maximum percent iron, 0.1 maximum percent magnesium, balance nickel and impurities.

13. The method of claim 1, wherein the step of providing the precursor mixture includes the step of providing the alloy components in a ratio of about 79 percent by weight of the higher-melting-point alloy component to about 21 percent by weight of the lower-melting-point alloy component.

14. The method of claim 1, wherein the step of applying the restoration coating includes the step of applying the restoration coating to a thickness of from about 0.100 inch to about 0.160 inch.

15. The method of claim 1, wherein the step of heating includes the step of heating the article to a temperature of from about 2250° F. to about 2350° F.

16. The method of claim 1, wherein the step of heating includes the step of heating the article to a temperature of from about 2295° F. to about 2325° F.

17. A method for repairing a nickel-base superalloy article comprising the steps of providing the nickel-base superalloy article that has previously been in service, wherein the nickel-base superalloy article has a nominal composition in weight percent of about 7.5 percent cobalt, about 7.0 percent chromium, about 1.5 percent molybdenum, about 5 percent tungsten, about 3 percent rhenium, about 6.5 percent tantalum, about 6.2 percent aluminum, about 0.15 percent hafnium, about 0.05 percent carbon, about 0.004 percent boron, about 0.01 percent yttrium, balance nickel and impurities; and applying a restoration coating to a surface of the article, wherein the restoration coating has a nominal composition in weight percent of about 10.2 percent chromium, about 5.6 percent cobalt, about 7.2 percent aluminum, about 4.3 percent tantalum, about 1.3 percent rhenium, about 3.1 percent tungsten, about 0.1 percent hafnium, about 2.1 percent silicon, substantially no yttrium, balance nickel and impurities, by the steps of providing a precursor mixture comprising a higher-melting-point alloy component, and a lower-melting-point alloy component, wherein the higher-melting point alloy component and the lower-melting-point alloy component together comprise the nominal composition of the restoration coating; thereafter forming a preform of the higher-melting-point alloy component and the lower-melting-point alloy component; thereafter applying the preform to the surface of the article, and thereafter heating the article with the preform applied to the surface thereof to a sufficiently high temperature to melt the lower-melting-point alloy component.

18. The method of claim 17, wherein the step of providing the precursor mixture includes the step of providing the alloy components in a ratio of about 79 percent by weight of the higher-melting-point alloy component to about 21 percent by weight of the lower-melting-point alloy component.

19. The method of claim 17, wherein the step of providing the precursor mixture includes the step of providing the higher-melting-point alloy component having a nominal composition in weight percent of about 3.1 percent cobalt, about 7.6 percent chromium, about 0.1 percent maximum molybdenum, about 3.85 percent tungsten, about 0.02 percent maximum titanium, about 1.65 percent rhenium, about 0.55 percent silicon, about 5.45 percent tantalum, about 7.8 percent aluminum, about 0.15 percent hafnium, about 0.02 percent carbon, balance nickel and impurities.

20. The method of claim 17, wherein the step of providing the precursor mixture includes the step of providing the lower-melting-point alloy component having a nominal composition in weight percent of 14.0–16.0 percent cobalt, 19.0–21.0 percent chromium, 4.5–5.5 percent aluminum, 0.05 maximum carbon, 7.7–8.1 percent silicon, 0.5 maximum percent iron, 0.1 maximum percent magnesium, balance nickel and impurities.

21. An article comprising:

a nickel-base superalloy article that has previously been in service; and a precursor mixture of a restoration coating applied to a surface of the article, wherein the precursor mixture has no more than about 12 weight percent chromium and no more than about 0.01 percent yttrium, and wherein the precursor mixture comprises a higher-melting-point alloy component, and a lower-melting-point alloy component.

* * * * *